US010043470B2

(12) United States Patent
Wang et al.

(10) Patent No.: US 10,043,470 B2
(45) Date of Patent: Aug. 7, 2018

(54) ARRAY SUBSTRATE AND LIQUID CRYSTAL DISPLAY DEVICE HAVING SAME

(71) Applicant: Century Technology (Shenzhen) Corporation Limited, Shenzhen (CN)

(72) Inventors: Ming-Tsung Wang, New Taipei (TW); Lin Li, Shenzhen (CN); Zhi-Wei Ye, Shenzhen (CN)

(73) Assignee: Century Technology (Shenzhen) Corporation Limited, Shenzhen (CN)

( * ) Notice: Subject to any disclaimer, the term of this patent is extended or adjusted under 35 U.S.C. 154(b) by 335 days.

(21) Appl. No.: 14/849,824

(22) Filed: Sep. 10, 2015

(65) Prior Publication Data

US 2016/0293127 A1 Oct. 6, 2016

(30) Foreign Application Priority Data

Mar. 31, 2015 (CN) ..... 2015 1 0147003

(51) Int. Cl.
*G09G 3/36* (2006.01)

(52) U.S. Cl.
CPC ..... *G09G 3/3655* (2013.01); *G09G 3/3614* (2013.01); *G09G 2320/029* (2013.01)

(58) Field of Classification Search
CPC ..... G09G 3/3655; G09G 3/3614; G09G 2320/029
See application file for complete search history.

(56) References Cited

U.S. PATENT DOCUMENTS

2011/0102401 A1* 5/2011 Feng ..... G09G 3/3655 345/211
2013/0314393 A1* 11/2013 Min ..... G09G 3/36 345/212
2014/0028535 A1* 1/2014 Min ..... G09G 3/18 345/87
2014/0092077 A1* 4/2014 Kim ..... G09G 3/3611 345/212

* cited by examiner

*Primary Examiner* — Aneeta Yodichkas
(74) *Attorney, Agent, or Firm* — ScienBiziP, P.C.

(57) ABSTRACT

An array substrate includes a display area, an edge area, data lines, pixel units, a feedback transmission line, a feedback control circuit, and a display drive circuit. The edge area surrounds the display area. The feedback transmission line, the feedback control circuit, and the display drive circuit are spatially corresponding to the edge area. The feedback transmission line electrically connects at least one of the data lines and the feedback control circuit. The feedback transmission line detects a data signal transmitted by the data lines and outputs a feedback signal to the feedback control circuit. The feedback control circuit outputs a common voltage to the display drive circuit according to the feedback signal. The display drive circuit outputs the common voltage to the pixel units.

13 Claims, 6 Drawing Sheets

ARRAY SUBSTRATE AND LIQUID CRYSTAL DISPLAY DEVICE HAVING SAME

FIELD

The subject matter herein generally relates to liquid crystal display technologies, and particularly to a liquid crystal display device with a feedback transmission circuit.

BACKGROUND

Liquid crystal display devices are widely applied in many electrical devices, for example, monitors, television sets, and mobile phones. The liquid crystal display devices apply liquid crystal capacitors constituted by pixel electrodes, common electrodes, and liquid crystal layers to maintain an electrical field to rotate the liquid crystal molecules and control the passing of light to display images. However, when the liquid display devices transfer from a frame of image to another frame of image, common voltages applied to the common electrodes are easily affected by the capacitors' coupling signals, such that crosstalk is generated. To solve the crosstalk problem, feedback circuits are generally applied to detect the common voltages and generate feedback signals.

The feedback circuits are generally positioned on flexible printed circuit boards. The flexible printed circuit boards are independently positioned outside substrates of the liquid crystal display devices. The flexible printed circuit boards include signal processing circuits. The signal processing circuits amplify the feedback signals and reduce the noise of the feedback signals and then transmit the processed feedback signals back to display drive circuits of the liquid crystal display devices. The display drive circuits adjust electrical potentials of the common electrodes, so as to improve the quality of the images.

BRIEF DESCRIPTION OF THE DRAWINGS

Implementations of the present technology will now be described, by way of example only, with reference to the attached figures, wherein.

DETAILED DESCRIPTION

Figure 1:
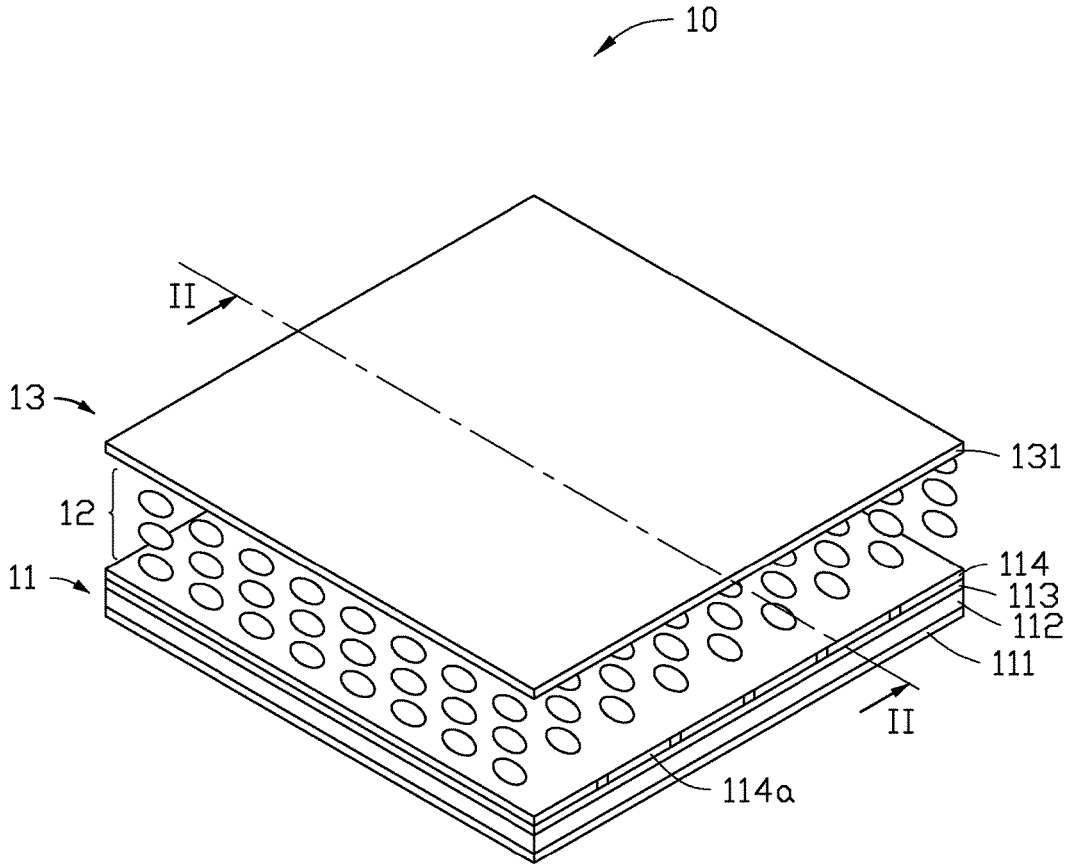
FIG. 1 is a diagram illustrating an embodiment of a liquid crystal display device of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proterminalions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
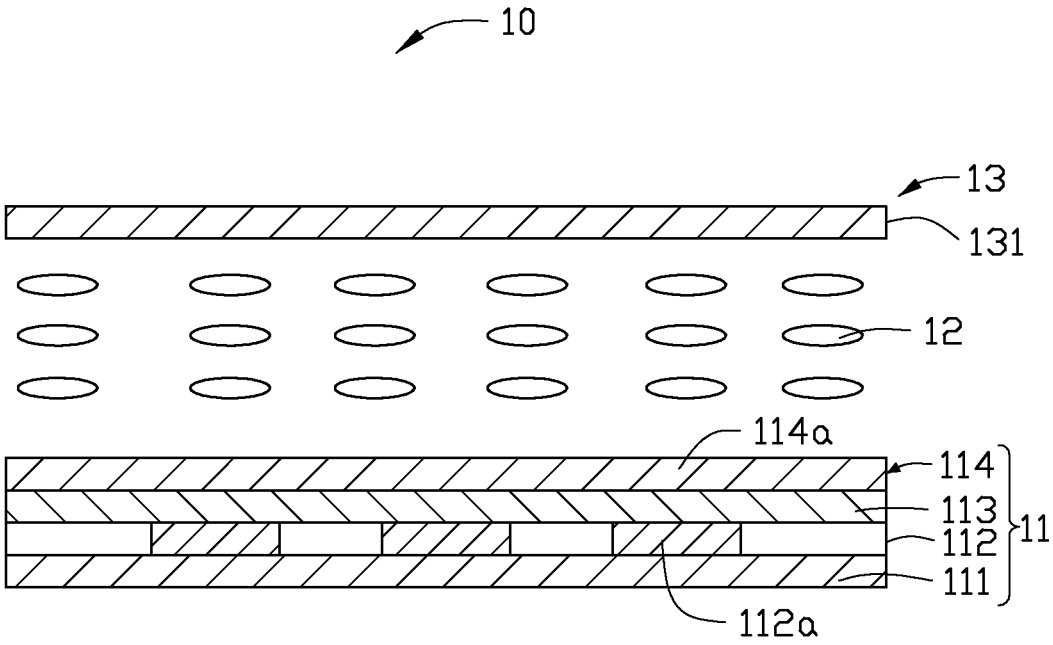
FIG. 2 is another diagram illustrating the liquid crystal display device of FIG. 1.

Referring to FIGS. 1 and 2, an embodiment of a liquid crystal display device 10 is shown. The liquid crystal display device 10 includes an array substrate 11, a liquid crystal layer 12, and a color filtering substrate 13. The array substrate 11 and the color filtering substrate 13 are positioned opposite to each other. The liquid crystal layer 12 is positioned between the array substrate 11 and the color filtering substrate 13.

In at least one embodiment, the array substrate 11 includes a first base 111, a pixel electrode layer 112, an insulative layer 113, and a common electrode layer 114. The pixel electrode layer 112 is positioned on the first base 111. The pixel electrode layer 112 includes a plurality of pixel electrodes 112*a* and the pixel electrodes 112*a* are arranged in an array. The insulative layer 113 covers a surface of the pixel electrode layer 112. The common electrode layer 114 is positioned on the insulative layer 113 and includes a plurality of common electrodes 114*a*. The pixel electrodes 112*a* and the common electrodes 114*a* cooperatively generate an electrical field to drive the liquid crystal molecules in the liquid crystal layer 12 to display images.

The color filtering substrate 13 includes a second base 131 and a color filtering layer. The color filtering layer includes color filtering material and opaque material. The color filtering material is positioned spatially corresponding to the pixel electrodes 112*a*. The opaque material is dislocated to the pixel electrodes 112*a*.

The first base 111 and the second base 131 are both made of transparent glass material or transparent plastic material. In at least one embodiment, the pixel electrodes 112*a* and the common electrodes 114*a* are made of indium tin oxide material or indium zinc oxide material.

Figure 3:
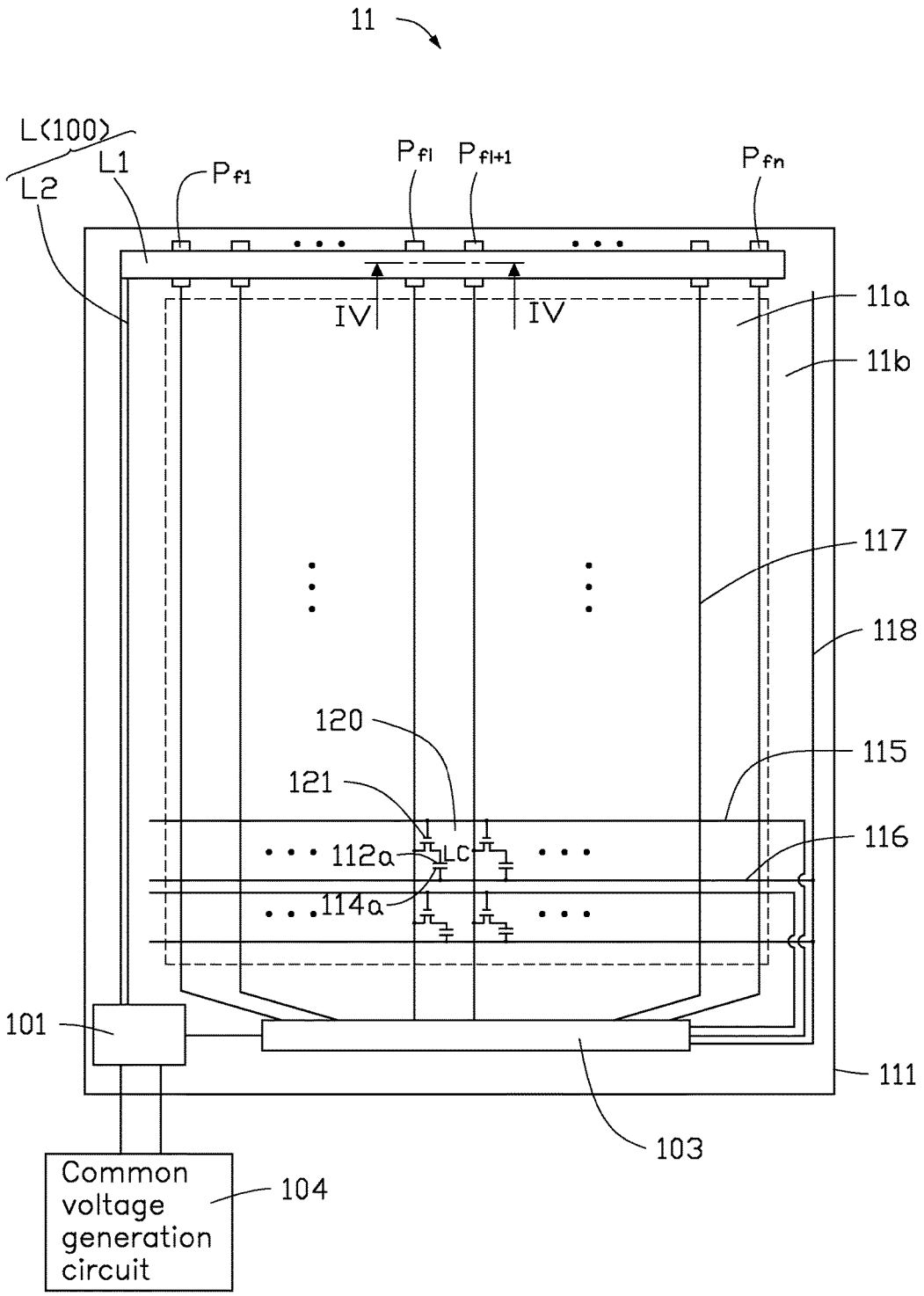
FIG. 3 is a diagram illustrating an array substrate of the liquid crystal display device of FIG. 1.

Referring to FIG. 3, the array substrate 11 includes a display area 11*a* and an edge area 11*b* surrounding the display area 11*a*. The array substrate 11 includes a plurality of parallel scanning lines 115, a plurality of parallel common electrode lines 116, a plurality of data lines 117, and a plurality of pixel units 120. The scanning lines 115 are separated from each other. The common electrode lines 116 are separated from each other and separated from the scanning lines 115. The data lines 117 are positioned perpendicular to the scanning lines 115 and insulative to the scanning lines 115. Each of the pixel units 120 is defined by two neighboring scanning lines 115 and two neighboring data lines 117.

Each of the pixel units 120 includes a thin film transistor 121, a pixel electrode 112*a*, and a common electrode 114*a*. A gate electrode of the thin film transistor 121 is electrically connected to a respective one of the scanning lines 115, a source electrode of the thin film transistor 121 is electrically connected to a respective one of the data lines 117, and a drain electrode of the thin film transistor 121 is electrically connected to a respective one of the pixel electrodes 112*a*. The pixel electrode 112*a*, the common electrode 114*a*, and a portion of the liquid crystal layer 12 surrounding by the pixel electrode 112*a* and the common electrode 114*a* constitute a liquid crystal capacitor LC. The thin film transistor 121 can be metal insulator semiconductor or low temperature poly-silicon semiconductor.

The edge area 11*b* is a non-display area. The array substrate 11 includes a feedback transmission line 100, a feedback control circuit 101, and a display drive circuit 103. The feedback transmission line 100 is electrically connected to at least one of the data lines 117 and the feedback control circuit 101. The feedback transmission line 100 outputs a feedback signal SF to the feedback control circuit 101 according to the data signal transmitted by the data lines 117. The feedback control circuit 101 outputs a common voltage $V_{com}$ to the display drive circuit 103 according to the feedback signal SF.

The display drive circuit 103 is positioned on a side of the array substrate 11 and is spatially corresponding to the edge area 11*b*. The display drive circuit 103 is electrically connected to the scanning lines 115 and the data lines 117. The display drive circuit 103 is electrically connected to the common electrode lines 116 through a common bus line 118. The display drive circuit 103 is configured to output an activate signal through the scanning lines 115 to control the thin film transistor 121 to turn on. The display drive circuit 103 is also configured to transmit the data signal to the pixel electrode 112*a* through the data line 117 and the thin film transistor 121 and transmit the common voltage V. to the common electrode 114*a* through the common electrode 116. As a result, the pixel electrode 112*a* and the common electrode 114*a* cooperatively display the data signal.

The liquid crystal display device 10 includes a common voltage generation circuit 104 for generating the common voltage $V_{com}$. The common voltage $V_{com}$ includes a first common voltage $V_{com1}$ and a second common voltage $V_{com2}$. The polarities of the first and second voltages $V_{com1}$, $V_{com2}$ are reverse to each other. In at least one embodiment, the first common voltage $V_{com1}$ has a negative polarity, while the second common voltage $V_{com2}$ has a positive polarity. The common voltage generation circuit 104 can be positioned outside the array substrate 11, integrated in the display drive circuit 103, or positioned on the edge area 11*b* of the array substrate 11.

Figure 4:
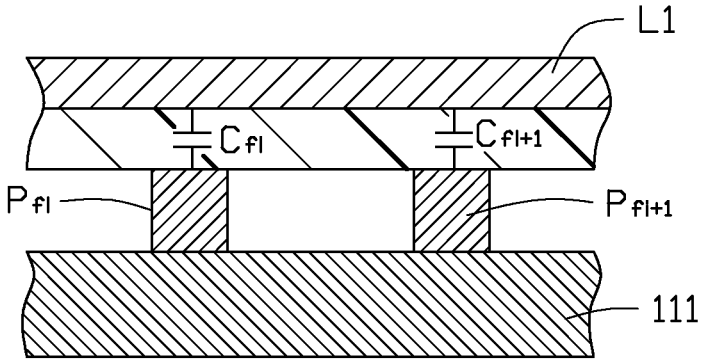
FIG. 4 is a cross-sectional diagram of the array substrate of FIG. 3, taken along line IV-IV.

Referring also to FIG. 4, the feedback transmission line 100 is electrically coupled to each of the data lines 117. In at least one embodiment, the feedback transmission line 100 is a feedback conductive wire L, the feedback conductive wire L includes a feedback detection portion L1 and a feedback transmission portion L2. The feedback detection portion L1 is positioned on a side of the array substrate 11*a* and is spatially opposite to the display drive circuit 103. The feedback detection portion L1 is dielectrically crossing distal ends Pf1-Pfn of the data lines 117. The distal ends Pf1-Pfn of the data lines 117 is positioned away from the display drive circuit 103. As shown in FIG. 4, an insulative layer is positioned between the feedback detection portion L1 and the distal ends Pfi, Pfi+1 of two of the data lines 117. As a result, the feedback detection portion L1 and the distal ends Pfi, Pfi+1 constitute two capacitors Cfi, Cfi+1. The two capacitors Cfi, Cfi+1 are parallelly connected. The two capacitors Cfi, Cfi+1 constitute a feedback capacitor Cf. In the illustrated embodiment, the feedback capacitor Cf is constituted by all the data lines 117 and the feedback detection portion L1. The feedback capacitor Cf detects the polarities of the data signals transmitted by the data lines 117 and further outputs the feedback signal Sf. For example, when the polarities of the data signals transmitted by the data lines 117 are positive, the feedback capacitor Cf outputs a feedback signal Sf having a positive polarity; similarly, when the polarities of the data signals transmitted by the data lines 117 are negative, the feedback capacitor Cf outputs a feedback signal Sf having a negative polarity.

In at least one embodiment, the feedback transmission portion L2 is made of conductive strip.

The feedback transmission portion L2 is positioned on the edge area 11*b* between the feedback detection portion L1 and the display drive circuit 103. One end of the feedback transmission portion L2 is electrically connected to the feedback transmission portion L1, and another end of the feedback transmission portion L2 is electrically connected to the feedback circuit 101, so as to transmit the feedback signal Sf to the feedback control circuit 101.

The feedback transmission portion L2 is striped shape. A width of the feedback transmission portion L2 is less than a width of the feedback detection portion L1, for reducing the impact of the feedback transmission portion L2 to the feedback capacitor Cf.

Figure 5:
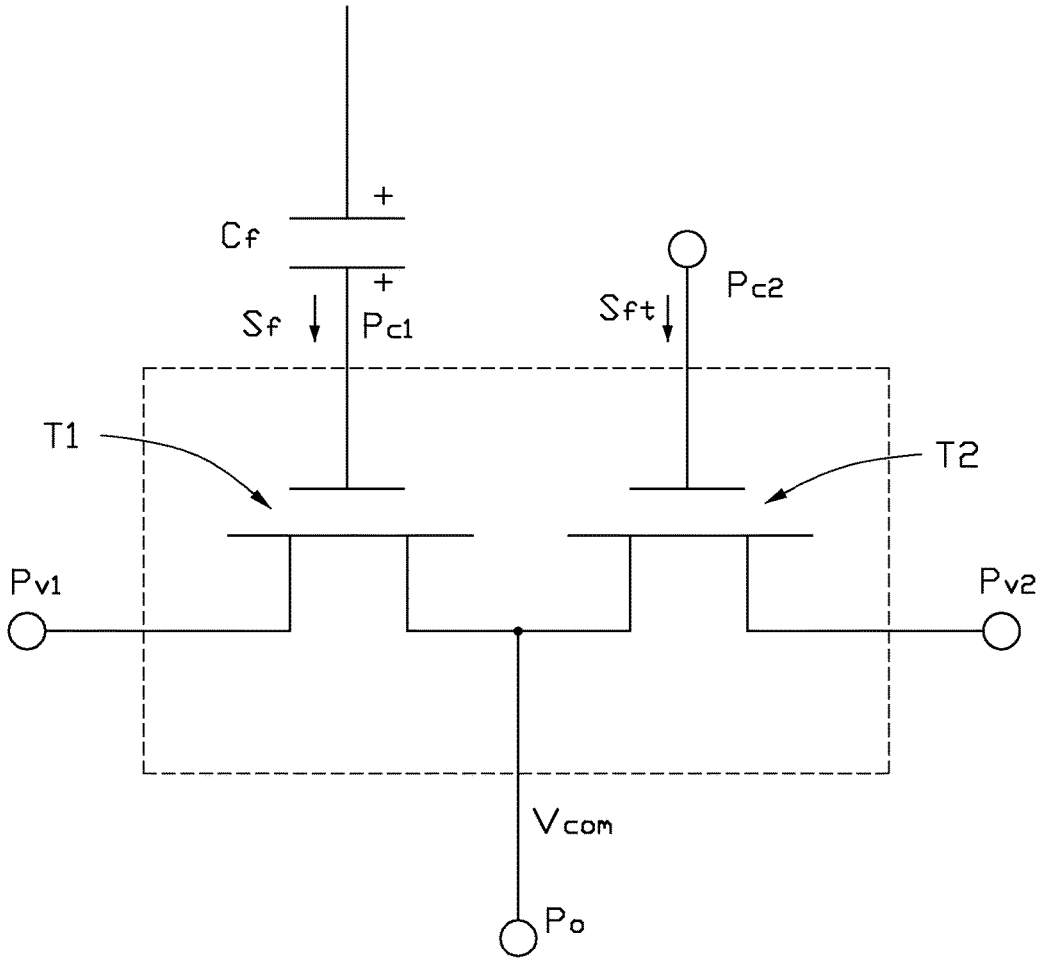
FIGS. 5 is a diagram illustrating an equivalent circuit of a feedback control circuit of the array substrate of FIG. 3.
Figure 6:
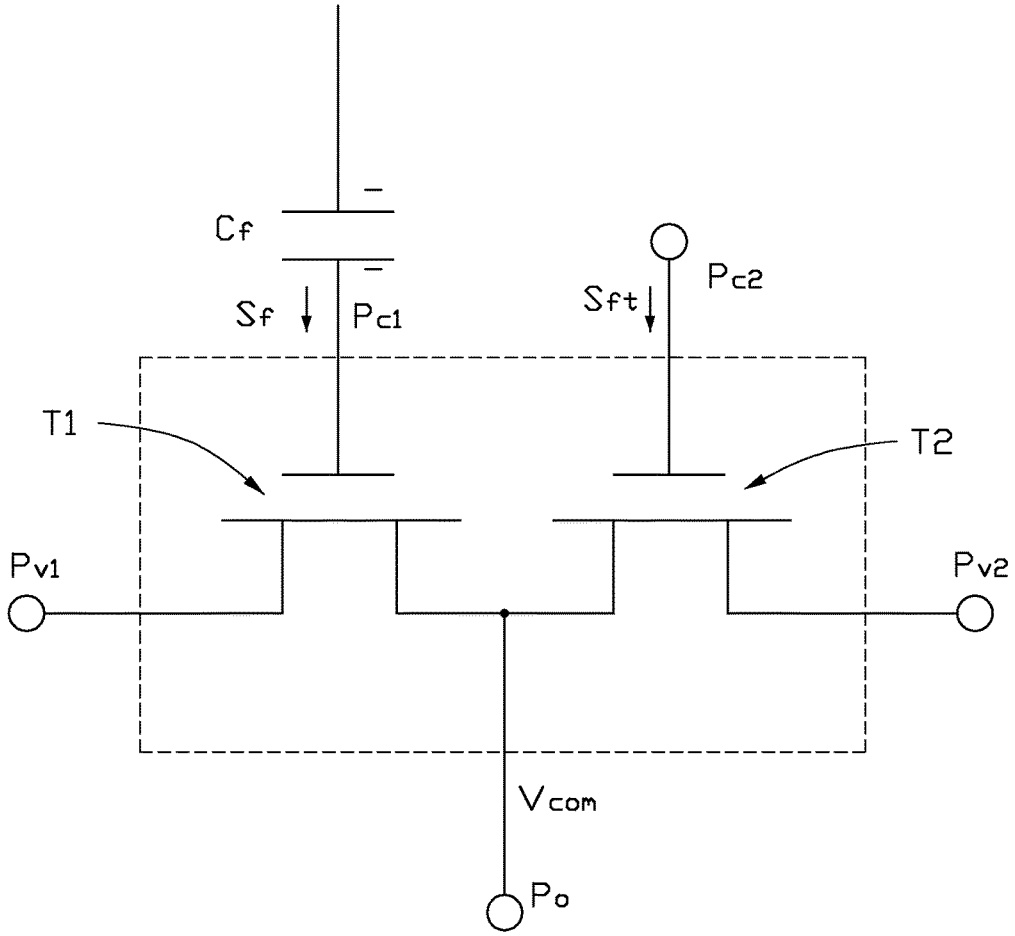
FIG. 6 is another diagram illustrating the equivalent circuit of the feedback control circuit of the array substrate of FIG. 3.

FIGS. 5 and 6 illustrate equivalent circuits of the feedback transmission line 100 and the feedback control circuit 101 of FIG. 2. FIG. 5 shows the working state of the feedback control circuit 101 when the polarity of the data signal is positive, while FIG. 6 shows the working state of the feedback control circuit 101 when the polarity of the data signal is negative.

The feedback control circuit 101 includes a first feedback control terminal Pc1, a second feedback control terminal Pc2, a first common voltage input terminal Pv1, a second common voltage input terminal Pv2, a feedback output terminal Po, a first switch unit T1, and a second switch unit T2.

The first feedback control terminal Pc1 is electrically connected to the feedback transmission portion L2 of the feedback transmission line 100. The second feedback control terminal Pc2 receives a floating signal Sft. The first common voltage input terminal Pv1 receives a first common voltage $V_{com1}$, and the second common voltage input terminal Pv2 receives a second common voltage $V_{com2}$.

The feedback control circuit 101 selectively connects one of the first common voltage input terminal Pv1 and the second common voltage input terminal Pv2 to the first feedback output terminal Po according to the polarity of the data signal, such that one of the first common voltage $V_{com1}$ and the second common voltage $V_{com2}$ is output to the first feedback output terminal Po.

The first switch unit T1 is an N type thin film transistor. A gate electrode of the first switch unit T1 is electrically connected to the first feedback control terminal Pc1, a drain electrode of the first switch unit T1 is electrically connected to the common voltage input terminal Pv1, and the source electrode of the first switch unit T1 is electrically connected to the first feedback output terminal Po. The first switch unit T1 selectively connects the first common voltage input terminal Pv1 to the first feedback output terminal Po according to the feedback signal Sf. For example, when the polarity of the feedback signal Sf is positive, the first switch unit T1 is turned on and the first common voltage input terminal Pv1 electrically connects the first feedback output terminal Po; when the polity of the feedback signal Sf is negative, the first switch unit T1 is turned off and the first common voltage input terminal Pv1 is disconnected to the first feedback output terminal Po.

The second switch unit T2 is an N type thin film transistor.

A gate electrode of the second switch unit T2 is electrically connected to the second feedback control terminal Pc2, a drain electrode of the second switch unit T2 is electrically connected to the second common voltage input terminal Pv2, and a source electrode of the second switch unit T2 is electrically connected to the first feedback output terminal Po. When the first switch unit T1 disconnects the first feedback control terminal Pv1 to the first feedback output terminal Po under the control of the feedback signal Sf, the second switch unit T2 connects the second common voltage input terminal Pv2 to the first feedback output terminal Po under the control of the floating signal Sft, so as to output the second common voltage Vcom2 to the first feedback output terminal Po.

For example, when the polarity of the feedback signal Sf is negative and the first switch unit T1 is turned off, the second switch unit T2 is turned on under the control of the floating signal Sft, and the second common voltage input terminal Pv2 connects the first feedback output terminal Po, so as to output the second common voltage Vcom2 to the first feedback output terminal Po.

In at least one embodiment, an activating voltage Vth1 of the first switch unit T1 is greater than an activating voltage of the second switch unit T2. When the first switch unit T1 and the second switch unit T2 are both turned on, the current going through the first switch unit T1 is greater than the current going through the second switch unit T2, and the on-resistance of the first switch unit T1 is less than the on-resistance of the second switch unit T2. As a result, the first common voltage $V_{com1}$ corresponding to the first switch unit T1 is output to the first feedback output terminal Po. When the voltage of the floating signal Sf is 0V and the voltage applied to the gate electrode of the second switch unit T2 is 0v, the second switch unit T2 is turned on.

The first switch unit T1, the second switch T2, and the thin film transistor 121 are all formed on the first base 111.

In use, when the polarity of the data signal transmitted by the data line 117 is positive, the feedback capacitor Cf outputs a feedback signal Sf having a positive polarity to the first switch unit T1, the first switch unit T1 is turned on, the common voltage $V_{com1}$ is output to the display drive circuit 103, and the display control circuit 103 outputs the first common voltage $V_{com1}$ to the common electrode 114*a* as the common voltage $V_{com}$.

When the polarity of the data signal transmitted by the data line 117 is negative, the feedback capacitor Cf outputs a feedback signal Sf having a negative polarity to the first switch unit T1, the first switch unit T1 is turned off, the second switch unit T2 is turned on, the second common voltage $V_{com1}$ is output to the display drive circuit 103, and the display control circuit 103 outputs the second common voltage $V_{com2}$ to the common electrode 114 as the common voltage $V_{com}$.

In the liquid crystal display device 10, the feedback control circuit 101 is directly positioned on the array substrate 11 spatially corresponding to the edge area 11*b*, so as to reduce the transmission distance of the feedback signal Sf and increase the accuracy and the real time ability of the signal transmission.

In other embodiments, the first switch unit T1 and the second switch unit T2 can be P type thin film transistors or metal oxide semiconductors, and the common electrode 114*a* can also be positioned on the color filtering substrate 12.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An array substrate comprising:

a display area;

an edge area surrounding the display area;

a plurality of data lines spatially corresponding to the display area;

a plurality of pixel units spatially corresponding to the display area;

a feedback transmission line spatially corresponding to the edge area;

a feedback control circuit spatially corresponding to the edge area, the feedback transmission line electrically connected to at least one of the data lines and the feedback control circuit, the feedback transmission line configured to detect a transmission of a data signal by the data line and output a feedback signal to the feedback control circuit; and a display drive circuit spatially corresponding to the edge area;

wherein the display drive circuit is configured to output the common voltage to the pixel units;

wherein the feedback control circuit comprises a first feedback control terminal, a second feedback control terminal, a first common voltage input terminal, a second common voltage input terminal, a feedback output terminal, a first switch unit, and a second switch unit; the first feedback control terminal is electrically connected to the feedback transmission line, the second feedback control terminal is configured to receive a floating signal, the first common voltage input terminal is configured to receive a first common voltage, the second common voltage input terminal is configured to receive a second common voltage, polarities of the first and second common voltage are reverse to each other, and the feedback control circuit is configured to selectively connect one of the first and second common voltage input terminals to the feedback output terminal according to a polarity of the feedback signal; the first switch unit is electrically connected to the first feedback control terminal, the first common voltage input terminal, and the feedback output terminal; the second switch unit is electrically connected to the second feedback control terminal, the second common voltage input terminal, and the feedback output terminal.

2. The array substrate of claim 1, wherein the edge area is a non-display area, and the feedback transmission line, the feedback control circuit, and the display drive circuit are all directly positioned on the edge area.

3. The array substrate of claim 1, wherein the feedback transmission line comprises a feedback conductive wire, one end of the feedback conductive wire is electrically connected to the feedback control circuit, and another end of the feedback conductive wire and a distal end of the least one data line constitute a feedback capacitor.

4. The array substrate of claim 3, wherein the display drive circuit is positioned on a side of the edge area and electrically connected to the data lines, the feedback conductive wire is dielectrically connected to distal ends of all the data lines, and the feedback conductive wire and the distal ends constitute the feedback capacitor.

5. The array substrate of claim 4, wherein the feedback conductive wire comprises a feedback detection portion and a feedback transmission portion, the feedback detection portion disconnects the distal ends, the feedback detection portion and the distal ends constitute the feedback capacitor, and the feedback transmission portion is electrically connected between the feedback detection portion and the feedback control circuit.

6. The array substrate of claim 5, wherein the feedback detection portion and the feedback transmission portion are each made of striped shaped conductive material, and a width of the feedback detection portion is greater than a width of the feedback transmission portion.

7. The array substrate of claim 3, wherein when a polarity of the data signal is positive, the feedback capacitor outputs the feedback signal having a positive polarity; when the polarity of the data signal is negative, the feedback capacitor outputs the feedback signal having a negative polarity; the feedback signal is output to the feedback control circuit through the feedback transmission line.

8. The array substrate of claim 7, wherein when the polarity of the data signal is positive, the feedback control circuit outputs the common voltage with a negative polarity to the display drive circuit; when the polarity of the data signal is negative, the feedback control circuit outputs the common voltage with a positive polarity to the display drive circuit.

9. The array substrate of claim 1, wherein the first switch unit selectively connects the first common voltage input terminal to the feedback output terminal according to the feedback signal; when the first feedback control terminal disconnects to the feedback output terminal under the control of the feedback signal, the second switch unit is turned on and the second common voltage input terminal connects to the feedback output terminal under the control of the floating signal, such that the second common voltage is output to the feedback output terminal.

10. The array substrate of claim 9, wherein the first switch unit and the second switch unit are both N type thin film transistors; a gate electrode of the first switch unit is electrically connected to the first feedback control terminal, a drain electrode of the first switch unit is electrically connected to the first common voltage input terminal, and a source electrode of the first switch unit is electrically connected to the feedback output terminal; a gate electrode of the second switch unit is electrically connected to the second feedback control terminal, a drain electrode of the second switch unit is electrically connected to the second common voltage input terminal, and a source electrode of the second switch unit is electrically connected to the feedback output terminal.

11. The array substrate of claim 9, wherein an activating voltage of the first switch unit is greater than an activating voltage of the second switch unit; when the first switch unit and the second switch unit are both turned on, the first common voltage is selected to be output to the feedback output terminal through the first common voltage input terminal.

12. The array substrate of claim 11, wherein when a voltage of the floating signal is 0V and the voltage applied to the gate electrode of the second switch unit is 0V, the second switch unit is turned on.

13. The array substrate of claim 1, wherein each pixel unit comprises a pixel electrode and a common electrode, the data signal is applied to the pixel electrode, the common voltage is applied to the common electrode, the display drive circuit applies the data signal to the data lines and applies the common voltage to the common electrode.

* * * * *